US006915244B2

(12) United States Patent
Yamano et al.

(10) Patent No.: US 6,915,244 B2
(45) Date of Patent: Jul. 5, 2005

(54) METHOD FOR PREDICTING AN AMOUNT OF DIMENSIONAL ACCURACY DEFECT AT THE TIME OF PRESS-FORMING METAL SHEET

(75) Inventors: Takayuki Yamano, Kakogawa (JP); Jiro Iwaya, Kakogawa (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 959 days.

(21) Appl. No.: 09/733,905

(22) Filed: Dec. 12, 2000

(65) Prior Publication Data

US 2001/0013239 A1 Aug. 16, 2001

(30) Foreign Application Priority Data

Jan. 31, 2000 (JP) ..... 2000-022773

(51) Int. Cl.[7] ..... G06F 17/10
(52) U.S. Cl. ..... 703/2; 703/7; 73/783
(58) Field of Search ..... 703/2, 7; 73/783

(56) References Cited

U.S. PATENT DOCUMENTS 5,379,227 A * 1/1995 Tang et al. ..... 700/98
6,205,366 B1 * 3/2001 Tang et al. ..... 700/97
6,544,354 B1 * 4/2003 Kawano et al. ..... 148/320
6,731,996 B1 * 5/2004 MacEwen et al. ..... 700/97

* cited by examiner

*Primary Examiner*—Albert W. Paladini
(74) *Attorney, Agent, or Firm*—Oblon, Spivak, McClelland, Maier & Neustadt, P.C.

(57) ABSTRACT

A method in which engineers having no experience and technical storage can preliminarily easily and accurately predict an amount of dimensional accuracy defect which occurs at the time of press-forming a metal sheet before press-forming without having expertise such numerical value simulations and mathematics. In predicting an amount of dimensional accuracy defect at the time of press-forming a metal sheet, as a stress-strain relationship, an elastic-perfectly plastic solid model having a fixed stress value after being yielded is adopted and a value which is equal to or less than a tensile strength and exceeds a yield strength is used as an apparent yield strength.

9 Claims, 17 Drawing Sheets

INFLUENCE OF STRENGTH

INFLUENCE OF SHEET THICKNESS (t)

DRAWING FORMING

BENDING FORMING

DESIGN (TARGET) SHAPE

WALL WARP

ANGULAR CHANGE

INFLUENCE OF STRENGTH

INFLUENCE OF SHEET THICKNESS (t)

METHOD FOR PREDICTING AN AMOUNT OF DIMENSIONAL ACCURACY DEFECT AT THE TIME OF PRESS-FORMING METAL SHEET

BACKGROUND OF THE INVENTION

1. Field of the Invention

The present invention relates to a method for predicting an amount of dimensional accuracy defect which is caused when a metal sheet such as a thin steel sheet, an aluminum sheet or the like which is mainly applied to an automobile body is formed by a press, and more particularly to a method which can preliminarily simply and accurately predict an amount of dimensional accuracy defect (mainly, a wall warp amount, an angular change amount or the like) of a formed product caused by an elastic recovery after removing the product from a mold in a press forming.

2. Description of the Prior Art

Many parts of an automobile body are generally constituted by parts which are produced by press-forming thin steel sheets. However, in forming these parts by a press-forming, due to an elastic recovery behavior after the removal from mold (the removal of a formed product from a mold), the shape (dimension) of the formed product is changed from the designed value and there exists a case that drawbacks take place at the time of assembling or joining formed products. The joining is mainly a joining by a spot welding. These drawbacks are generally called dimensional accuracy defects. As such dimensional accuracy defects, the wall warp and the angular change or the like are known.

Recently, from the viewpoint of making the automobile body light-weighted and increasing the stability of the automobile, cases that thin steel sheets having a high strength or aluminum sheets being light-weighted but having a lower Young's modulus compared to the steel sheets are used as the material for the automobile body have been increasing and hence, the above-mentioned dimensional accuracy defects have been taken as crucial problems.

To solve such problems, as means for enhancing the dimensional accuracy, (A) the development of new techniques and (B) the adjustment by predictive techniques and the like have been mainly carried out. As a technique belonging to (A), inventors of the present invention have proposed a method which reduces a wall warp amount by applying a tension to wall portion by increasing the blank holding force at the final state of the press operation. As a technique belonging to (B), there has been known a method which predicts an elastic recovery amount after the removal of the sheet from a mold and determines the dimension of a mold with a value which is obtained by subtracting the predicted value of the elastic recovery amount from the target product dimension and then adjusts the dimension to the prescribed dimension after removing the sheet from the mold.

With respect to the above-mentioned two means, whichever means is adopted, it is extremely important to preliminarily accurately predict an amount of dimensional accuracy defect after forming based on information on a metal sheet to be formed, forming conditions and the like.

Heretofore, in predicting an amount of dimensional accuracy defect after press-forming a metal sheet, there have been known (1) a method which performs the prediction based on the experience of skilled workers, the stored past results and the like, (2) a method which performs the prediction based on a numerical simulations and the like. However, it has been pointed out that either one of these methods suffers from following problems.

With respect to the method (1), it is difficult for engineers having a little experience or a little storage of techniques to perform an accurate prediction and hence, the method (1) is not suitable for a practical operation. On the other hand, with respect to the method (2), although various techniques which are proposed in "Sosei to Kako" (for example, vol. 36, No.410 (1995) p203–210, vol.37, No. 410(1996) p1352–1336 and the like) have been known, the expertise such as numerical simulations, mathematics or the like is necessary and there also exists a problem that a simulation facility such as a computer becomes large-sized.

SUMMARY OF THE INVENTION

The present invention has been made under the above-mentioned background and it is an object of the present invention to provide a method which enables engineers who do not have the experience and the storage of technique and also do not have the expertise such as the numerical simulation, mathematics and the like can preliminarily simply and accurately predict an amount of dimensional accuracy defect at the time of press-forming a metal sheet.

The gist of a prediction method of the present invention capable of achieving the above-mentioned object lies in that, in predicting an amount of dimensional accuracy defect at the time of press-forming a metal sheet, as a stress-strain relationship, an elastic-perfectly plastic solid model having a fixed stress value is adopted after yielding and a value which is equal to or less than the tensile strength and exceeds the yield strength is called an apparent yield strength.

As the specific constitution of the above-mentioned method, a constitution which uses an internal division value obtained by a following equation (1) based on the yield strength (YS) and the tensile strength (TS) which are actually measured as the above-mentioned apparent yield strength (σp') is considered.

$$\sigma p' = k \cdot YS + (1-k)TS \tag{1}$$

where k is a coefficient of the internal division value

Further, the coefficient k in the above-mentioned equation (1) can be expressed as a function [k=f(TS/t)] of the ratio (TS/t) between the tensile strength TS and the plate thickness t and takes a value in the range of 0<k<1.

In the above-mentioned method of the present invention, in predicting a wall warp amount at the time of press-forming, the wall warp amount is predicted based on ρ which is obtained by following equations (2)–(4).

$$\rho = (3\sigma p'/Et)\cdot\{1 - D\cdot[(\sigma_T/TS) - 0.3]^2\} - C\cdot(rd - 5) \tag{2}$$

$$\sigma p' = k\cdot YS + (1-k)TS \tag{3}$$

$$k = A\cdot(TS/t) + B \tag{4}$$

where ρ=wall warp amount (curvature; 1/mm), σp': apparent yield strength (MPa), E: Young's modulus (MPa), t: sheet thickness(mm), TS: tensile strength (actually measured value; MPa), YS: yield strength (actually measured value; MPa), $\sigma_T$: tension acting on wall portion (MPa), rd: radius of die shoulder of press forming tool (mm), k: coefficient of internal division value, A: negative constant, B, C, D: positive constant.

Further, in the above-mentioned method of the present invention, in predicting an angular change amount at the time of press-forming, the angular change amount is predicted based on Δθ which is obtained by following equations (5)–(8).

$$\Delta\theta = -\theta \cdot (rp + t/2) \cdot \Delta\rho \quad (5)$$

$$\Delta\rho = (-3\sigma p'/Et) \cdot [1 + \exp(-G \cdot rp)] \quad (6)$$

$$\sigma p' = k \cdot YS + (1-k)TS \quad (7)$$

$$k = A \cdot (TS/t) + B \quad (8)$$

where Δθ: angular change amount (degree), θ: bending angle (degree), rp: radius of shoulder of bending tool (mm), t: sheet thickness (mm), Δρ: curvature change amount (1/mm), σp': apparent yield strength (MPa), E: Young's modulus (MPa), YS: yield strength (actually measured value; MPa),TS: tensile strength (actually measured value; MPa), k: coefficient of internal division value, A: negative constant, B, G: positive constant.

DESCRIPTION OF THE PREFERRED EMBODIMENT

Inventors of the present invention have carried out extensive studies from various aspects to solve the above-mentioned drawbacks. Eventually the inventors have made a finding that with the adoption of the above-mentioned constitution, the above-mentioned object of the present invention can be achieved. Following the procedure which has led to the completion of the present invention, the manner of operation and the advantageous effects of the present invention are explained hereinafter in conjunction with attached drawings. In the explanation described hereinafter, for the explanation purpose, a case in which a "hat channel" specimen which is popularly used for parts of an automobile is formed as a material to be subjected to the prediction of an amount of dimensional accuracy defect is picked up and explained. However, it is needless to say that the material to be subjected to the prediction of an amount of dimensional accuracy defect in the present invention is not limited to such a "hat channel" specimen.

Figure 1:
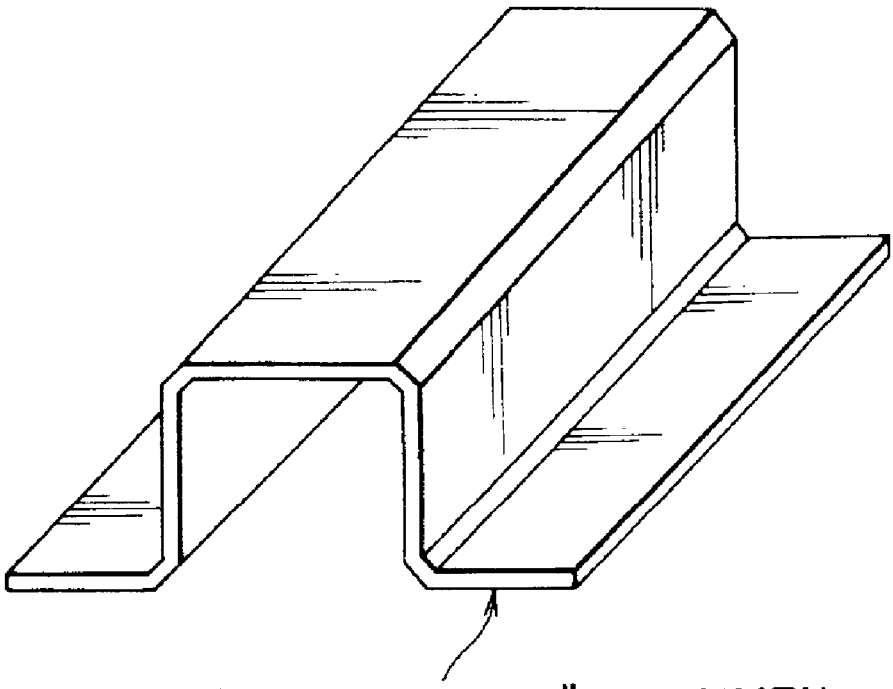
FIG. 1 is an explanatory view showing an example of an outer appearance of a "hat channel" specimen.
Figure 2A:
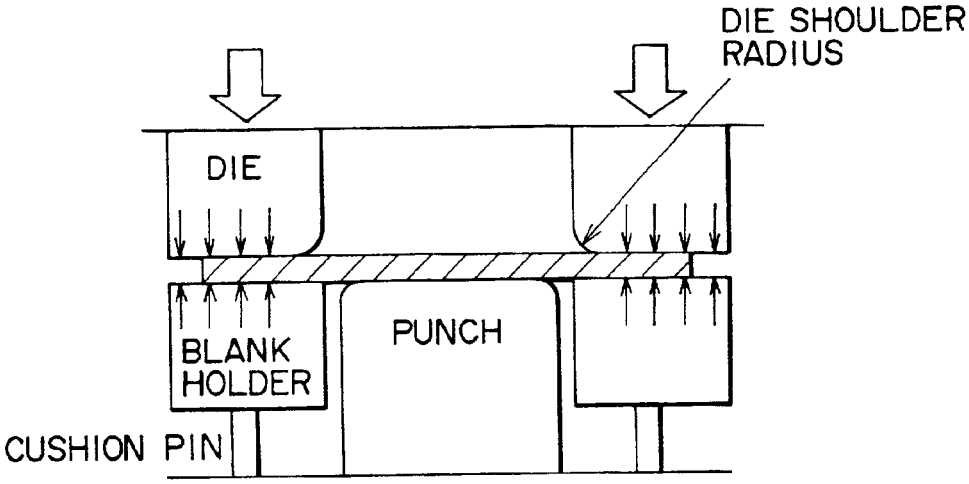
FIG. 2 is a schematic explanatory view showing a main forming method of a "hat channel" specimen.
Figure 2B:
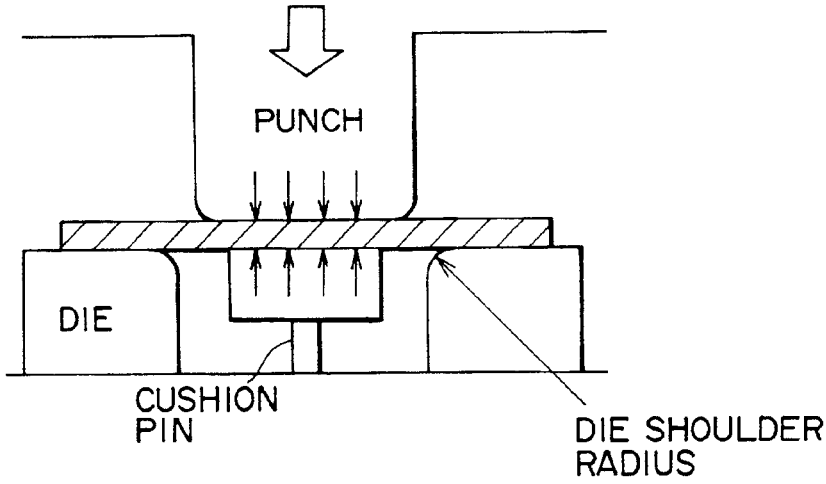

FIG. 1 is an explanatory view showing an example of an outer configuration of the above-mentioned "hat channel" specimen. As a major method for forming such a "hat channel" specimen, as shown in FIG. 2, a drawing forming method (FIG. 2(*a*)) and a bending forming method (FIG. 2(*b*)) are known. In these forming methods, the dimensional accuracy defect which constitutes problem in particular is comprised of a "wall warp" phenomenon which occurs mainly at the time of performing a deep drawing and an "angular change" phenomenon which occurs at the time of performing a bending.

Figure 3A:
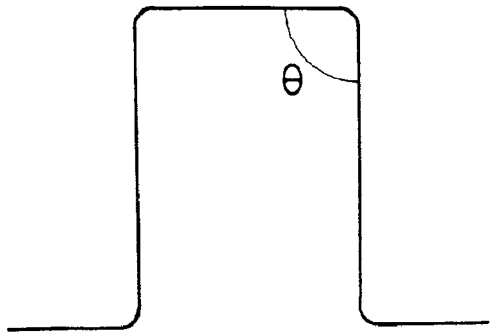
FIG. 3 is a view for explaining the dimensional accuracy defects which are subjects of the present invention.
Figure 3B:
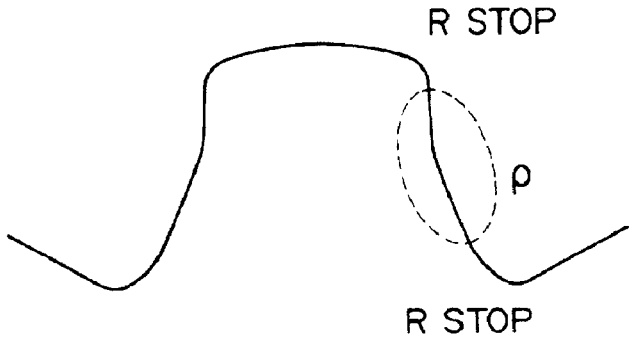
Figure 3C:
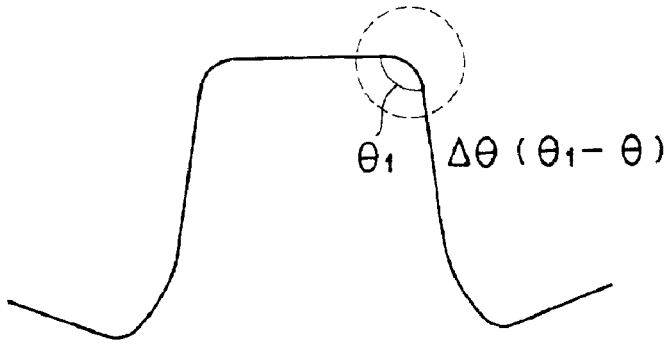
Figure 4A:
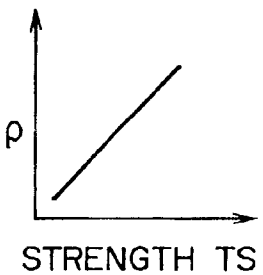
FIG. 4 is graphs showing the relationship between major influence factors which affect a wall warp and a wall warp amount ρ.
Figure 4B:
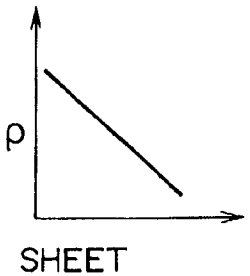
Figure 4C:
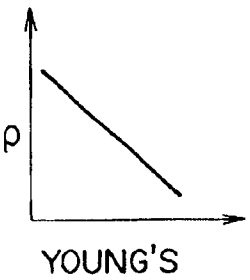
Figure 4D:
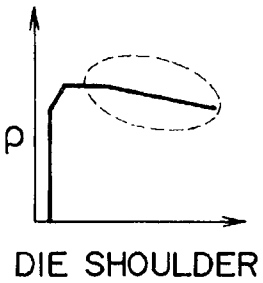
Figure 4E:
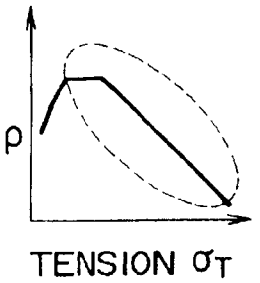

Assuming that a design (target) shape (a cross-sectional shape perpendicular to an axis) of the "hat channel" specimen is a shape shown in FIG. 3(*a*), the "wall warp"

phenomenon is a phenomenon in which a wall portion between R stops (R being the radius of a die shoulder of a press forming tool) is warped as indicated by a broken line portion of FIG. 3(*b*). Further, assuming a target angle of a bending portion as θ (FIG. 3(*a*)), the "angular change" phenomenon is a phenomenon in which the bending portion is formed with an angle$\theta_1$ which is larger than the target angleθ as indicated by a broken line portion of FIG. 3(*c*). The wall warp amount ρ is expressed by a curvature (1/mm) of the above-mentioned R, while the angular change amount Δθ is expressed by the difference between target angle θ and the angle $\theta_1$ made after forming the hat channel" specimen. Then, the specific method for predicting these wall warp amount ρ and angular change amount Δθ is explained hereinafter in detail.

At the time of performing the deep drawing, a metal sheet subjected to such a forming receives the bending/unbending deformation when the metal sheet passes a shoulder portion of a press forming tool (die shoulder). Accordingly, at the time of forming, in the wall portion, the difference between stresses having opposite signs (the difference between a tensile stress and a compression stress) is generated on the front and back in the sheet thickness direction (see FIG. 9 and FIG. 10 which will be explained later). Although a bending moment is generated in the sheet thickness direction due to this difference between stresses having opposite signs, when an external force is removed at the time of removing the metal sheet from the mold, the deformation is recovered to some extent due to the elasticity which the material holds (elastic recovery). It is known that this elastic recovery behavior is the major cause of the wall warp. The elastic recovery behavior is generated so as to make the bending moment zero and the strain and the stress remain in the sheet thickness direction as shown in FIGS. 11(*b*), (*c*) which will be explained later.

Further, it has been known that following tendencies (1) to (5) exist with respect to the wall warp amount ρ. Here, the relationship between the major influence factors which affect the wall warp and the wall warp amount ρ is shown in FIG. 4.

(1) Corresponding to the increase of the strength (tensile strength TS) of the metal material, the wall warp amount ρ is also increased (FIG. 4(*a*)).

(2) Corresponding to the decrease of the sheet thickness t of the metal sheet, the wall warp amount ρ is increased (FIG. 4(*b*)).

(3) Corresponding to the decrease of the Young's modulus E of the metal material, the wall warp amount ρ is increased (FIG. 4(*c*)).

(4) Corresponding to the increase of the radius rd of the die shoulder of the press forming tool, the wall warp amount ρ is increased (FIG. 4(*d*)). However, the region where the radius rd of the die shoulder of the press forming tool is extremely small is excluded.

(5) Corresponding to the increase of the tension $\sigma_T$ (blank holding force) working on a wall portion, the wall warp amount ρ is increased (a region indicated by abroken line in FIG. 4(*e*)). However, the region where the tension is extremely small is excluded.

Figure 5:
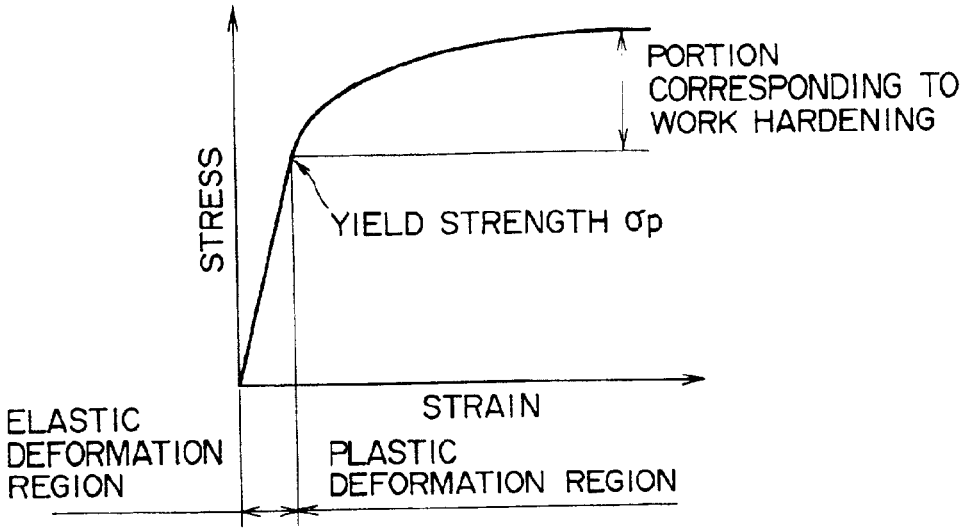
FIG. 5 is a stress-strain diagram used in a conventional prediction method.

The inventors of the present invention have made extensive studies from various aspects aiming at the realization of a prediction equation which can accurately (quantitatively) and easily predict these tendencies based on the above-mentioned finding. To this end, first of all, the inventors of the present invention have reviewed reasons why the complicate calculations such as numerical value simulations have been carried out in the prior art to predict the wall warp amount. As a result, we arrived at a conclusion that one of the main reasons is that, in the prior art, as the stress-strain relationship at the time of applying the deformation (strain), the relationship which is close to the reality as shown in FIG. 5, that is, the work hardening in the plastic deformation range where the stress is increased corresponding to the increase of the plastic strain is taken into consideration as the direct subject of the numerical value simulation.

Figure 6:
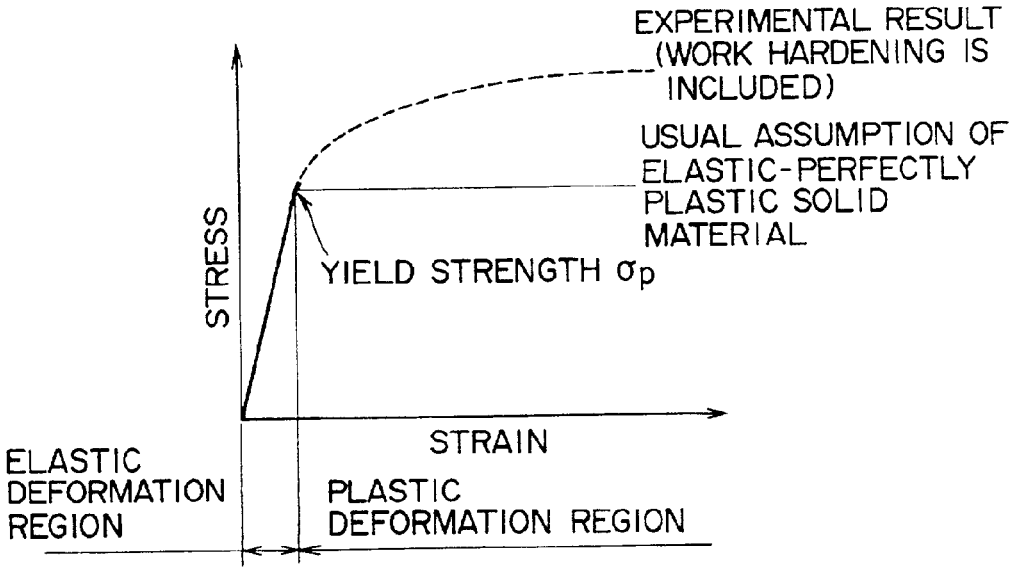
FIG. 6 is a stress-strain diagram when an elastic-perfectly plastic solid material (work hardening not considered) is assumed.

Accordingly, to simplify the prediction equation, the inventors of the present invention have assumed the stress-strain relationship that the metal material does not generate the work hardening although the relationship is different from the actual material behavior and then have tried to formulate the more simplified prediction equation under such a stress-strain relationship. That is, as shown in FIG. 6, the inventors have assumed a plastic material whose stress keeps a fixed value after yielding (a yielding stress σp) (such a plastic material being generally called an "elastic-perfectly plastic solid material") and then have tried to formulate the prediction equation based on such a plastic body.

As a result, the inventors of the present invention have found that an amount of curvature change due to the elastic recovery after bending/unbending deformation (the wall warp amount ρ when the tension is extremely small) can be expressed by a following simple equation (I). Further, the inventors of the present invention also have found that when a die having a die shoulder diameter of 3–20 mm which is popularly used in a usual press forming is used, the equation (I) can be expressed by a further simplified equation such as a following equation (II).

$$\rho=(3\sigma p/Et)\cdot\{1-7/3\cdot[(2\sigma p/Et)\cdot rd]^2\} \quad \text{(I)}$$

$$\rho\approx(3\sigma p/Et) \quad \text{(II)}$$

where σ=wall warp amount (curvature; 1/mm), σp: yield strength (MPa), E: Young's modulus (MPa), t: sheet thickness(mm), rd: radius of die shoulder of press forming tool (mm).

Figure 7A:
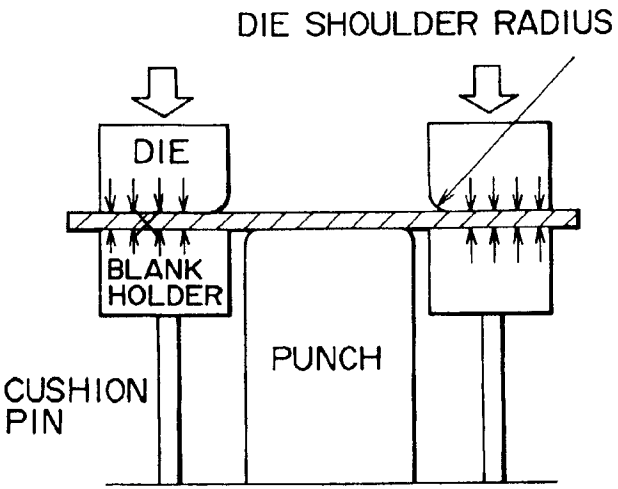
FIG. 7 is a view for explaining the deformation history of a wall portion of material subjected to a press-forming.
Figure 7B:
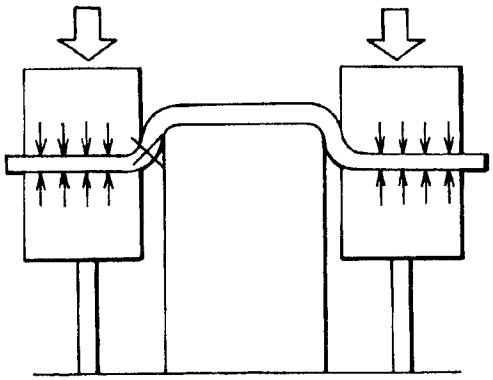
Figure 7C:
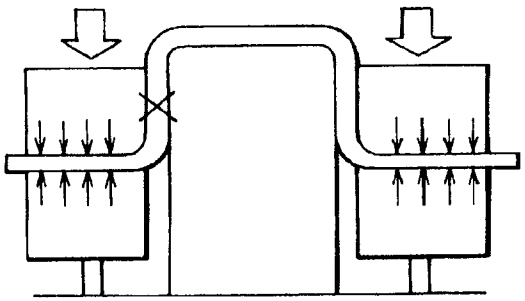

The above-mentioned equations (I) (II) can be formulated by analyzing the change of bending moment in the deformation steps at the time of press-forming. This procedure is explained in conjunction with drawings. FIG. 7 is a view for explaining the deformation history of a wall portion of a metal sheet subjected to the press-forming (particularly deep drawing). In the drawing, the metal sheet is sequentially formed by a press in the order of FIG. 7(*a*)→FIG. 7(*b*) →FIG. 7(*c*). A portion of the metal sheet where the wall warp occurs is indicated by a mark X as at the marked point in FIG. 7. FIG. 7(*a*) shows the stage before press-forming, FIG. 7(*b*) shows the bending stage, and FIG. 7(*c*) shows the unbending stage.

Figures 8A, 8B, 8C:
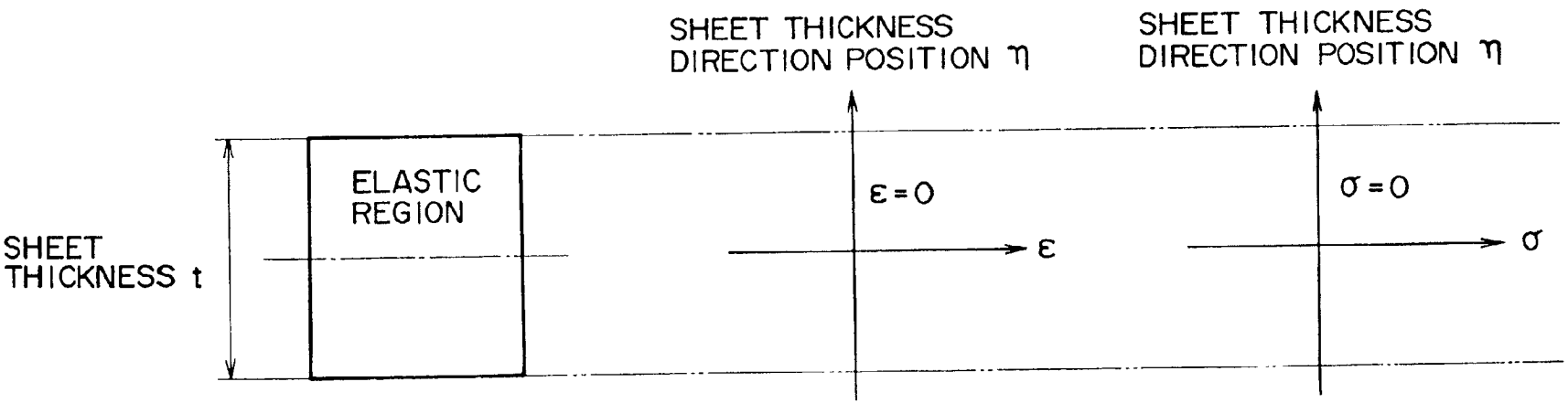
FIG. 8 is a view showing the distribution of the strain ϵ and the stress σ acting in the plate thickness direction of the material (at the marked point in FIG. 7) and the distribution of an elastic region and a plastic region in the inside of the material at a stage of FIG. 7(*a*).
Figures 9A, 9B, 9C:
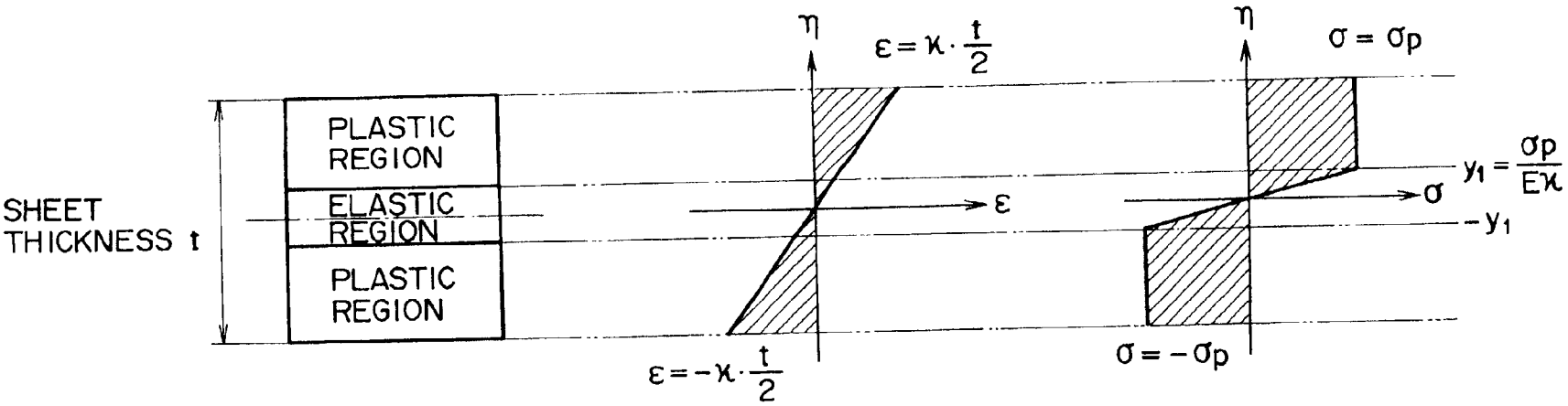
FIG. 9 is a view showing the distribution of the strain ϵ and the stress σ acting in the plate thickness direction of the material (at the marked point in FIG. 7) and the distribution of an elastic region and a plastic region in the inside of the material at a stage of FIG. 7(*b*).
Figures 10A, 10B, 10C:
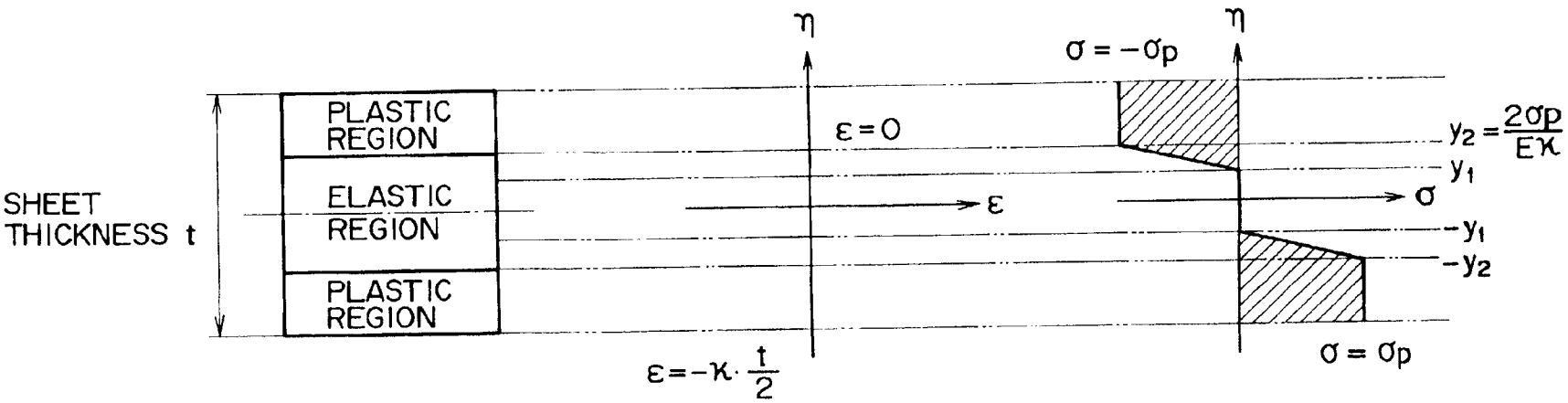
FIG. 10 is a view showing the distribution of the strain ϵ and the stress σ acting in the plate thickness direction of the material (at the marked point in FIG. 7) and the distribution of an elastic region and a plastic region in the inside of the material at a stage of FIG. 7(*c*).
Figures 11A, 11B, 11C:
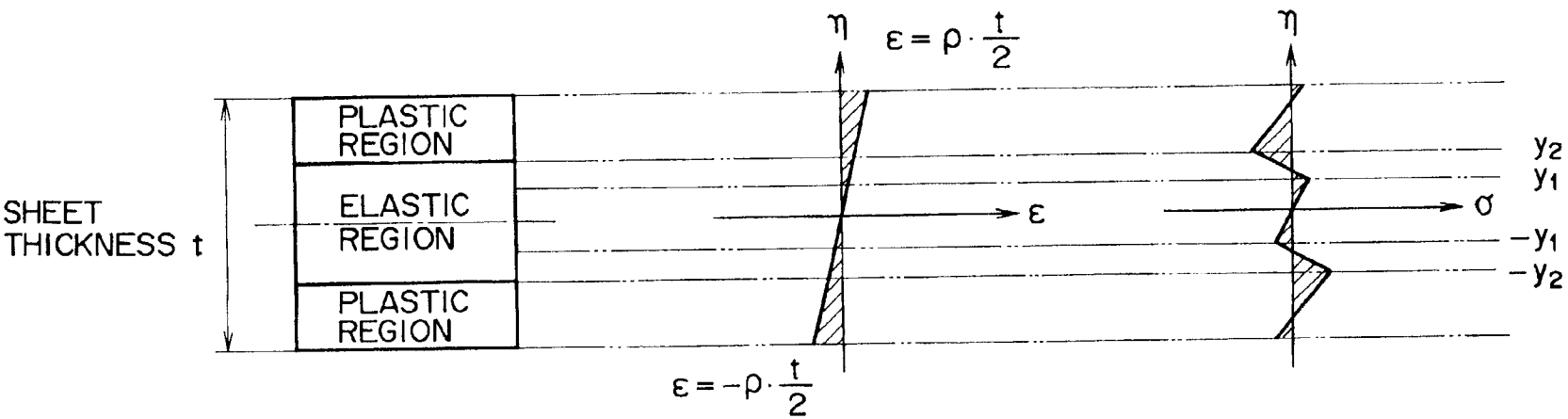
FIG. 11 is a view showing the distribution of the strain ϵ and the stress σ acting in the plate thickness direction of the material (at the marked point in FIG. 7) and the distribution of an elastic region and a plastic region in the inside of the material after removing a product from a mold.

On the other hand, FIG. 8 to FIG. 10 show the distribution of the strain ε and the stress σ acting in the sheet thickness direction of the metal sheet (the above-mentioned marked point X) and the distribution of an elastic region and a plastic region in the inside of the metal sheet at respective stages when the metal sheet is formed by the press in the order of FIG. 7(*a*)→FIG. 7(*b*)→FIG. 7(*c*). FIG. 8 corresponds to the stage shown in FIG. 7(*a*), FIG. 9 corresponds to the stage shown in FIG. 7(*b*), and FIG. 10 corresponds to the stage shown in FIG. 7(*c*). The distribution of the strain ε and the stress σ acting in the plate thickness direction of the metal sheet (the above-mentioned marked point X) and the distribution of an elastic region and a plastic region in the inside of the metal sheet after removing the product from the mold are shown in FIG. 11. Respective views (a) in FIGS. 8 to 11 indicate the distribution of the elastic region and the plastic region in the inside of the metal sheet. Respective views (b) in FIGS. 8 to 11 indicate the distribution of the strain $\epsilon$. Respective views (c) in FIGS. 8 to 11 indicate the distribution of the stress $\sigma$.

First of all, in the stage shown in FIG. 7(*a*), the marked point X is formed of the elastic region over the entire region in the sheet thickness direction (FIG. 8(*a*)) and neither the distribution of the strain $\epsilon$nor the distribution of the stress $\sigma$ is generated (FIGS. 8(*b*),(*c*)). As a result, no bending moment is generated in this stage. Accordingly, the bending moment amount $M_{①}$ acting on the central portion of the sheet thickness t can be expressed by a following equation (III), wherein the position $\eta$ in the sheet thickness direction is set as a variable.

$$M_{①} = \int_{-\frac{t}{2}}^{\frac{t}{2}} \sigma \cdot \eta d\eta = 0 \tag{III}$$

Then, in the stage (bending stage) shown in FIG. 7(*b*), in the marked point X, both end surface sides in the sheet thickness direction of the metal sheet become the plastic region and the central portion becomes the elastic region (FIG. 9(*a*)). Here, the distribution of the straine is made such that the strains having the maximum strain amount of $\kappa\cdot(t/2)$ are generated in the opposite directions, wherein the curvature is set to $\kappa$ (=1/rd; rd being the radius of die shoulder) (FIG. 9(*b*)). Further, here, when an amount of work hardening is ignored (FIG. 6 explained above), the distribution of the stress $\sigma$ is made such that the stresses having the maximum stress of $\sigma p$ are generated on the front surface side and the rear surface side in the different directions (compression stress and the tensile stress) (FIG. 9(*c*)). Due to such a stress distribution, the bending moment is generated. Then, assuming the position in the sheet thickness direction as $\eta$ and the distance from the sheet thickness center to both end portions of the elastic region as $+y_1$, $-y_1$ (FIG. 9(*c*)), $y_1$ becomes $y_1=\sigma p/(E\cdot\kappa)$ wherein E is the Young's modulus and $\kappa$ is the curvature. Accordingly, the bending moment $M_{②}$ acting on the central portion of the metal sheet is expressed by a following equation (IV).

$$\begin{aligned} M_{②} &= \int_{-\frac{t}{2}}^{\frac{t}{2}} \sigma \cdot \eta d\eta = \int_{-\frac{t}{2}}^{-y_1} -\sigma_P \cdot \eta d\eta + \\ &\int_{-y_1}^{-y_2} E \cdot \kappa \cdot \eta d\eta + \int_{y_1}^{\frac{t}{2}} \sigma_P \cdot \eta d\eta \\ &= \frac{t^2}{4} \cdot \sigma_P \cdot \left[1 - \frac{1}{3}\left(\frac{2\sigma_P}{E \cdot t \cdot \kappa}\right)^2\right] \\ &= \frac{t^2}{4} \cdot \sigma_P \cdot \left[1 - \frac{1}{3}\left(\frac{2\sigma_P}{E \cdot t} \cdot rd\right)^2\right] \end{aligned} \tag{IV}$$

Further, in the stage (unbending stage) shown in FIG. 7(*c*), in the marked position X of the material, the whole region once returns to the elastic region and thereafter the region is yielded again in the direction opposite to the direction of the stage of FIG. 7(*b*) (FIG. 10(*a*)) so that the distribution of the strain $\epsilon$ is not generated (FIG. 10(*b*)). Further, here, when an amount of work hardening is ignored, the distribution of the stress $\sigma$ is made such that the stresses having the maximum stress of $\sigma p$ ($\sigma p$ being the yield stress) are generated in the different directions from each other and in the directions opposite to the directions of FIG. 9(*c*) (FIG. 10(*c*)). Here, assuming the position in the sheet thickness direction as $\eta$ and the distance from the sheet thickness center to both end portions of the elastic region(elastic-plastic boundary) as $+y_2$, $-y_2$ (FIG. 10(*c*)), $y_2$ becomes $y_2=2\sigma p/(E\cdot\kappa)$, wherein E is the Young's modulus and $\kappa$ is the curvature. Accordingly, the bending moment amount $M_{③}$ acting on the central portion of the metal sheet is expressed by a following equation (V).

$$\begin{aligned} M_{③} &= \int_{-\frac{t}{2}}^{\frac{t}{2}} \sigma \cdot \eta d\eta = \int_{-\frac{t}{2}}^{-y_1} -\sigma_P \cdot \eta d\eta + \\ &\int_{-y_2}^{-y_2} (-\sigma_P - E \cdot \kappa \cdot \eta) dn + \int_{-y_1}^{-y_2} 0 \cdot \eta d\eta + \\ &\int_{y_2}^{y_2} (-\sigma_P - E \cdot \kappa \cdot \eta) dn + \int_{y2}^{\frac{t}{2}} -\sigma \cdot \eta d\eta \\ &= \frac{t^2}{4} \cdot \sigma_P \cdot \left[1 - \frac{7}{3}\left(\frac{2\sigma_P}{E \cdot t \cdot \kappa}\right)^2\right] \\ &= \frac{t^2}{4} \cdot \sigma_P \cdot \left[1 - \frac{1}{3}\left(\frac{2\sigma_P}{E \cdot t} \cdot rd\right)^2\right] \end{aligned} \tag{V}$$

Then, at the time of removing the metal sheet from the mold, the external force is released and hence, the whole region in the sheet thickness direction of the metal sheet becomes the elastic region (FIG. 11(*a*)) and the elastic recovery (wall warp $\rho$) is generated such that the bending moment amount which the region has due to the elasticity of the material becomes zero. Here, the distributions of the strain and stress which are generated in the sheet thickness direction are formed as shown in FIG. 11(*b*) (maximum strain $\epsilon=\rho\cdot(t/2)$) and FIG. 11(*c*).

Then, the bending moment amount e reduced by the above-mentioned elastic recovery can be expressed by a following equation (VI) and this elastic recovery is generated such that it cancels the bending moment amount M(3) which is generated by the distribution of the stress at the time of forming. Accordingly, the wall warp amount $\rho$ is generated corresponding to the bending moment amount M(4) which satisfies a following equation (VII).

$$e = \int_{\frac{t}{2}}^{\frac{t}{2}} E \cdot \rho \cdot \eta^2 d\eta \tag{VI}$$

$$M_{④} = M_{③} - \int_{-\frac{t}{2}}^{\frac{t}{2}} E \cdot \rho \cdot \eta^2 d\eta = M_{③} - \frac{E \cdot t^3}{12} \rho = 0 \tag{VII}$$

To put the above-mentioned equation (VII) in order with respect to the wall warp amount $\rho$, a following equation (VIII) is formulated. By putting the relationship of the above-mentioned equation (V) into this equation (VIII) and put them in order, the above-mentioned equation (I) is formulated.

$$\rho=(12/Et^3)\cdot M_{③} \tag{VIII}$$

By the way, in a usual press forming, the value of $7/3\cdot[(2\sigma p/Et)\cdot rd]^2$ in the second term of the right-hand member in the above-mentioned equation (I) becomes a value extremely smaller than 1. For example, assuming that $\sigma p$=600 MPa, rd=5 mm, E=205800 MPa, t=1.2 mm, the value of $7/3\cdot[(2\sigma p/Et)\cdot rd]^2$ becomes $1.38\times10^{-3}$ (<<1). Accordingly, the second term $\{1-7/3\cdot[(2\sigma p/Et)\cdot rd]^2\}$ of the right-hand member in the above-mentioned equation (I) becomes approximately 1 so that it can be ignored whereby the equation (I) can be further simplified like the above-mentioned equation (II).

The inventors of the present invention have compared the actually measured values of wall warp amount obtained by an experiment under various material strengths and forming conditions and the predicted values obtained by the above-mentioned equation (II). The actually measured values used here are sampled values at a relatively small region (the region surrounded by the broken line in FIGS. 4(*d*), (*e*)) where the radius of die shoulder is extremely small and the tension (blank holding force) is relatively small. As a result, it was found that, to accurately predict the wall warp amount, it is necessary to take the work hardening into consideration to some extent.

Figure 12:
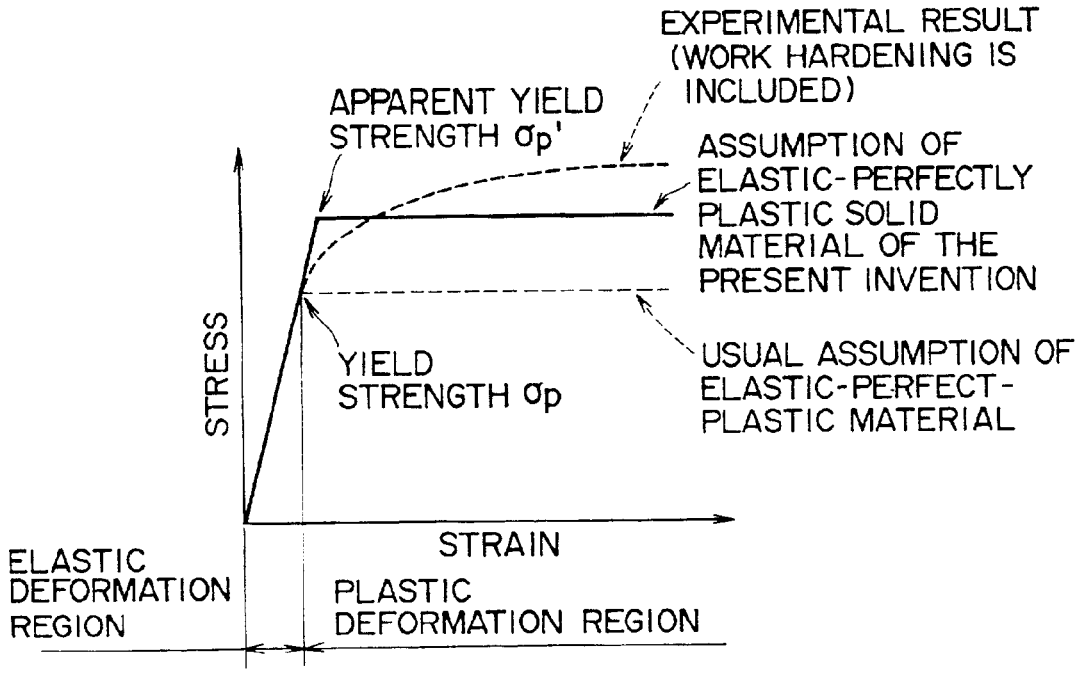
FIG. 12 is a stress-strain diagram used in the present invention.
Figure 13A:
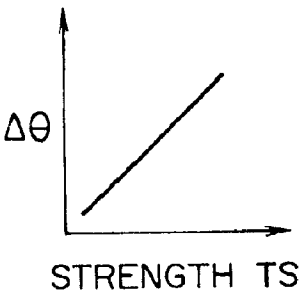
FIG. 13 is a graph showing the relationship between major influence factors which affect an angular change and an angular change amount Δθ.
Figure 13B:
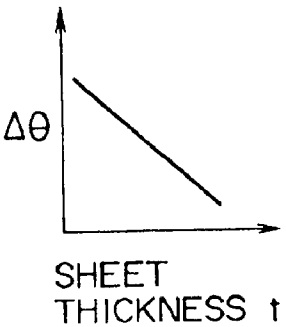
Figure 13C:
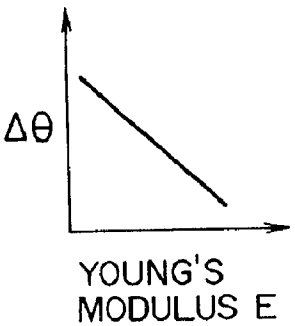
Figure 13D:
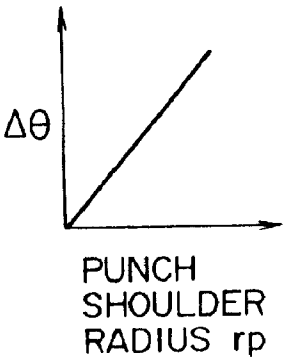

Then, to reflect the influence of the work hardening as much as possible, the inventors of the present invention have made further extensive studies. As a result, it was found that by setting a value which is equal to or less than the tensile stress and exceeds the yield stress σp as an apparent yield stress σp' which includes an amendment corresponding to the work hardening and is different from the reality in place of the yield stress σp of the above-mentioned equation (II), the wall warp amount ρ may be predicted by a following equation (II)' based on this apparent yield stress σp' as shown in FIG. 12. Further, it was found that when the above-mentioned apparent yield stress σp' is set to the internal division value obtained by the following equation (1) based on the actually measured yield strength YS and tensile strength TS or when a coefficient in the following equation (1) is set to a function (k=f (TS/t)) of the ratio (TS/t) between the tensile strength TS and the sheet thickness t, the actually measured value and the predicted value relatively favorably agree with each other.

Figure 21A:
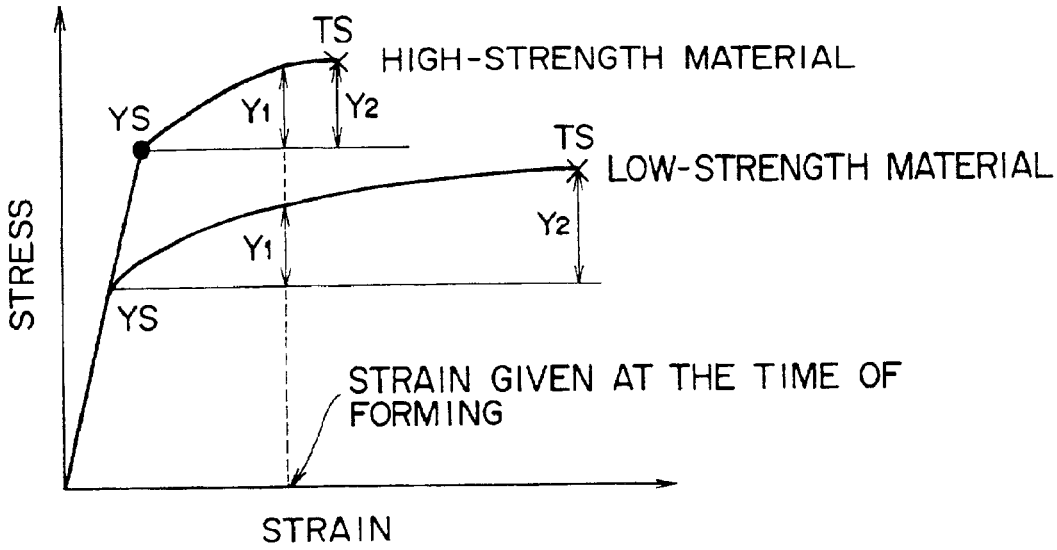
FIG. 21 is views showing the influence which the tensile strength and the thickness of sheet give to the work hardening.
Figure 21B:
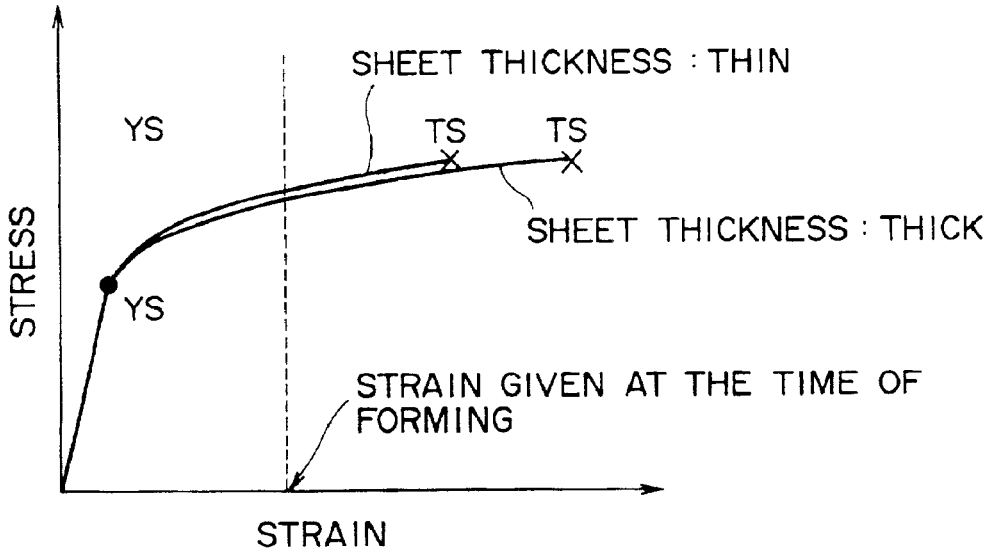

Here, as the above-mentioned yield strength YS and the tensile strength TS, values obtained by a usual tension test may be used. Further, the reason that the coefficient k is set to the function of TS/t can be explained as follows. In general, when the stress-strain diagram is measured by the tension test or the like, a tendency of work hardening shown in FIG. 21 is observed. With respect to materials having different tensile strength and sheet thickness, the degree of work hardening at the same strain value (working with same tool) can be summarized as follows.

(a) Corresponding to the increase of the tensile strength, the strain value which reaches TS becomes smaller and the degree of work hardening (being evaluated by Y1/Y2 in FIG. 21(*a*), for example) at the same strain value is increased. As a result, corresponding to increase of the tensile strength, the yield strength after work hardening becomes a value closer to the tensile strength TS.

(b) Corresponding to the decrease of the sheet thickness, the strain value which reaches TS becomes smaller and the degree of work hardening at the same strain value is increased. As a result, corresponding to the increase of the tensile strength, the yield strength after work hardening becomes a value closer to the tensile strength TS.

Various forms of functional equations which relate k, TS and t with each other in view of these tendencies are considered. Among these forms, it was experimentally confirmed that when the form which uses k as the function of TS/t is adopted, the actually measured values and the predicted values agree with each other.

$$\rho=(3\sigma p'/Et) \qquad \text{(II)'}$$

where ρ=wall warp amount (curvature; 1/mm), σp': apparent yield strength (MPa), E: Young's modulus (MPa), t: sheet thickness(mm).

$$\sigma p'=k\cdot YS+(1-k)\ Ts \qquad (1)$$

where k is the coefficient of the internal division value.

Here, in the above-mentioned equation (II)', the influence of the radius rd of die shoulder is not sufficiently expressed. However, when the inventors of the present invention have reviewed with respect to the manner of change of the actually measured value by an experiment, it was found that when a correction is made such that a correction term [−C·(rd−5)] obtained by the experiment is added to the above-mentioned equation (II)' to formulate a following equation (II)", the prediction accuracy is further enhanced.

$$\rho=(3\sigma p'/Et)-C\mathbf{19}\ (rd-5) \qquad \text{(II)"}$$

However, even with such an equation (II)", the influence of tension (blank holding force) is not sufficiently expressed. That is, the equation (II)" is only applicable to a region where the tension is relatively small (a region in the vicinity of the top of FIG. 4(*e*)). Accordingly, when the inventors of the present invention have reviewed the condition of change of actually measured values by an experiment with respect to the correction when the tension is large, it was found that when the correction which is formulated by a following equation (2) is made to the above-mentioned equation (II)", a favorable prediction accuracy can be obtained. That is, while satisfying the following equation (2) formulated in the above-mentioned manner, by setting the internal division value obtained by a following equation (3) (same as the previously mentioned equation (1)) based on the actually measured yield strength YS and the tensile strength TS obtained by the tension test as the apparent yield stress σp' and by adopting a following equation (4) using the coefficient k of the equation (3) as the function (k=f (TS/t)) of the ratio (TS/t) between the tension strength TS and the sheet thickness t, the wall warp amount ρ can be easily and accurately predicted.

$$\rho=(3\sigma p'/Et)\cdot\{1-D\cdot[(\sigma_T/TS)-0.3]^2\}-C\cdot(rd-5) \qquad (2)$$

$$\sigma p'=k\cdot YS+(1-k)TS \qquad (3)$$

$$k=A\cdot(TS/t)+B \qquad (4)$$

where ρ=wall warp amount (curvature; 1/mm), σp': apparent yield strength (MPa), E: Young's modulus (MPa), t: sheet thickness(mm), TS: tensile strength (actually measured value; MPa), YS: yield strength (actually measured value; MPa), $\sigma_T$: tension acting on wall portion (MPa), rd: radius of die shoulder of press forming tool (mm), k: coefficient of internal division value, A: negative constant, B, C, D: positive constant.

Subsequently, a case in which the angular change amount Δθ is predicted is explained. In the bending forming, a metal sheet to be subjected to such a forming receives the bending deformation from a shoulder portion or the like of a punch which constitutes a press forming tool. Accordingly, at the time of bending forming, in the metal sheet, the difference between stresses having opposite signs (the difference between a tensile strength and a compression stress) is generated on the front and back in the sheet thickness direction in the same manner as the deep drawing. It has been known that even when such stress difference is balanced at a point where an external force is removed at the time of the removal of the metal sheet from the mold and hence, the bending moment becomes zero, a part of the stress difference remains and generates the above-mentioned angular change phenomenon. Further, it has been known that following tendencies (1) to (4) exist with respect to the angular change amount Δθ.

(1) Corresponding to the increase of the strength (tensile strength TS) of the metal material, the angular change amount Δθ is also increased (FIG. 13(*a*)).

(2) Corresponding to the decrease of the sheet thickness of the metal sheet, the angular change amount $\Delta\theta$ is increased (FIG. 13(*b*)).

(3) Corresponding to the decrease of the Young's modulus E of the metal material, the angular change amount $\Delta\theta$ is increased (FIG. 13(*c*)).

(4) Corresponding to the increase of the radius rd of the shoulder of the bending tool (punch or the like), the angular change amount $\Delta\theta$ is increased (FIG. 13(*d*)).

To simplify the prediction equation, the inventors of the present invention have assumed the stress-strain relationship that the material does not generate the work hardening although it is different from the actual material behavior, as in the case of the above-mentioned prediction equation of the wall warp amount $\rho$ (FIG. 6 mentioned previously) and have tried to formulate the simpler prediction equation under such a relationship. However, since the angular change defect generated at the time of bending forming is generated at portions which receive only the bending caused by the shoulder portion or the like of the punch, it is unnecessary to take the unbending phenomenon into account.

As a result, it was found that the angular change amount $\Delta\theta$ after the bending deformation and the elastic recovery can be expressed by following simple equations such as an equation (5) and an equation (IX).

$$\Delta\theta=-\theta\cdot(rp+t/2)\cdot\Delta\rho \tag{5}$$

$$\Delta\rho=(-3\sigma p/Et)\cdot[1-\tfrac{1}{3}(2\sigma p'/Et)\cdot rp]^2] \tag{IX}$$

where $\Delta\theta$: angular change amount (degree), $\theta$: bending angle (degree), rp: radius of shoulder of bending tool (mm), t: sheet thickness (mm), $\Delta\rho$: curvature change amount (1/mm), $\sigma p'$: apparent yield strength (MPa), E: Young's modulus (MPa).

The above-mentioned equation (5) and the equation (IX) can be formulated in the following manner. That is, the curvature change amount $\Delta\rho$ of the bending portion due to the elastic recovery after bending forming is generated such that it cancels the bending moment M(3) as in the case in which the previously mentioned equation (VII) is formulated and hence, the curvature change amount $\Delta\rho$ is generated to satisfy a following equation (X).

$$M_{③}-\int_{-\frac{t}{2}}^{\frac{t}{2}}E\cdot\Delta\rho\cdot\eta d\eta=M_{③}-\frac{Et^3}{12}\cdot\Delta\rho=0 \tag{X}$$

Accordingly, the curvature change amount $\Delta\rho$ can be expressed by a following equation (XI) and the above-mentioned equation (IX) can be formulated by putting this equation (XI) in order.

$$\Delta\rho=(-12/Et^3)\cdot M_{③} \tag{XI}$$

On the other hand, to consider the geometric conversion of the above-mentioned curvature change amount $\Delta\rho$, since the length of the central portion of the sheet thickness does not change even after the curvature is changed, the relationship of a following equation (XIII) is established. By putting this equation (XIII) in order with respect to the angular change amount $\Delta\theta$, the previously-mentioned equation (5) can be formulated.

$$\theta/[1/[rp+(t/2)]]=(\theta+\Delta\theta)/[1/[rp+t/2]-\Delta\rho] \tag{XIII}$$

where:$\Delta\theta$: angular change amount (degree), $\theta$: bending angle (degree), rp: radius of shoulder of bending tool (mm), t: sheet thickness (mm), $\Delta\rho$: curvature change amount (1/mm).

In case a punch having a punch shoulder radius of approximately 3–20 mm which is popularly used in a usual press forming is used, the above-mentioned equation (IX) can be further simplified to a following equation (XII) as in the case of the deep drawing.

$$\Delta\rho=(-3\sigma p/Et) \tag{XII}$$

Further, in the present invention, since the influence of the work hardening is considered in a form as simple as possible, as in the case of the prediction equation of the wall warp amount, as the value of the yield strength $\sigma p$, the values defined by the previously mentioned equation (1) are used as the apparent yield strength $\sigma p'$ which is obtained by correcting an amount corresponding to the work hardening and is different from the actually measured value. Further, in the above-mentioned equation (XII), since the influence of the shoulder radius of the bending tool (punch or the like) is not sufficiently expressed, it was found that by judging the manner of changing of the actually measured values and performing the correction as expressed by a following equation (6), a favorable prediction accuracy can be obtained.

$$\Delta\rho=(-3\sigma p'/Et)\cdot[1+\exp(-G\cdot rp)] \tag{6}$$

That is, along with the equation (5) and the equation (6) formulated in the above-mentioned manner, by setting the internal division value formulated by a following equation (7) (same as the previously mentioned equation (1), (3)) based on the actually measured yield strength YS and the tensile strength TS obtained by the tension test as the apparent yield stress $\sigma$ p' and by adopting a following equation (8) using the coefficient k of the equation (7) as the function (k=f (TS/t)) of the ratio (TS/t) between the tension strength TS and the sheet thickness t, the angular change amount $\Delta\theta$ can be easily and accurately predicted.

$$\sigma p'=k\cdot YS+(1-k)TS \tag{7}$$

$$k=A\cdot(TS/t)+B \tag{8}$$

where $\sigma p'$: apparent yield strength (MPa), E: Young's modulus (MPa), YS: yield strength (actually measured value; MPa),TS: tensile strength (actually measured value; MPa), k: coefficient of internal division value, A, B, G: constant.

The advantageous effects of the present invention will be further specifically explained in conjunction with embodiments hereinafter. However, none of following embodiments limits the present invention and any design matters regarding the present invention are included in the technical scope of the present invention in view of the spirit of the present invention which has been explained heretofore and which will be explained hereinafter.

Embodiment 1

First of all, the prediction accuracy in the region (see FIG. 4(*e*)) where the tension is relatively small was confirmed. Using various kinds of steel sheets having the yield strength YP, the tensile strength TS and the sheet thickness t shown in following Table 1 and under forming conditions (die shoulder diameter rd) shown in the Table 1, a "hat channel" specimen forming experiment was carried out. Here, BHF (blank holding force) was adjusted such that the influence which the tension $\sigma_T$ affects the wall warp amount can be made as small as possible and the ratio ($\sigma_T$/TS) between the tension $\sigma_T$ and the tension strength TS substantially becomes constant (0.3: the region in vicinity of the top point in FIG. 4(*e*)).

TABLE 1

| No. | Yield strength (MPa) | Tensile strength (MPa) | Sheet thickness (mm) | Die shoulder radius (mm) | Actually measured value $\rho_{mes}$ [$\times 10^{-3}$ ($mm^{-1}$)] | Predicted value $\rho_{cal}$ [$\times 10^{-3}$ ($mm^{-1}$)] |
|---|---|---|---|---|---|---|
| 1 | 608 | 1009 | 1.2 | 5 | 12.196 | 12.255 |
| 2 | 373 | 608 | 1.4 | 5 | 5.100 | 5.365 |
| 3 | 406 | 596 | 1.2 | 5 | 5.788 | 6.469 |
| 4 | 362 | 457 | 1.0 | 5 | 5.393 | 6.146 |
| 5 | 351 | 450 | 1.0 | 5 | 5.571 | 6.012 |
| 6 | 277 | 444 | 1.6 | 5 | 2.407 | 3.213 |
| 7 | 177 | 306 | 1.2 | 5 | 2.048 | 2.826 |
| 8 | 406 | 596 | 1.2 | 5 | 6.697 | 6.469 |
| 9 | 463 | 611 | 1.4 | 5 | 5.151 | 5.757 |
| 10 | 324 | 616 | 1.4 | 5 | 5.177 | 5.231 |
| 11 | 373 | 608 | 1.4 | 15 | 4.390 | 4.284 |
| 12 | 406 | 596 | 1.2 | 15 | 5.691 | 5.388 |
| 13 | 362 | 457 | 1.0 | 15 | 4.172 | 5.065 |
| 14 | 351 | 450 | 1.0 | 15 | 5.634 | 4.931 |
| 15 | 277 | 444 | 1.6 | 15 | 2.483 | 2.132 |
| 16 | 177 | 306 | 1.2 | 15 | 2.565 | 1.745 |
| 17 | 463 | 611 | 1.4 | 15 | 4.398 | 4.676 |
| 18 | 324 | 616 | 1.4 | 15 | 4.172 | 4.150 |

Figure 14:
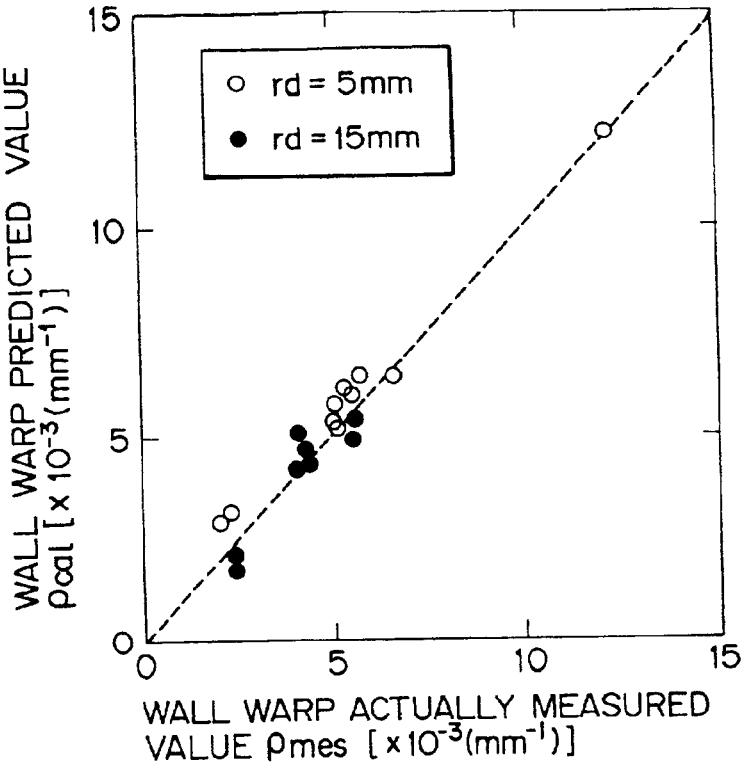
FIG. 14 is a graph showing in comparison an actually measured value (ρmes) and a predicted value (ρcal) based on the above-mentioned equations (2)–(4) with respect to wall warp amounts (curvatures) ρ of various kinds of steel sheets shown in Table 1.

With respect to the wall warp amount (curvature) ρ in the test, the actually measured values (ρmes) were shown in the Table 1. Using these actually measured values, the values of the constants A, B and C in the previously mentioned equations (2) to (4) were determined. Here, since the ratio $\sigma_T$/TS is set to $\sigma_T$/TS=0.3, the value of $D\cdot[(\sigma_T/TS)-0.3]^2$ does not depend on the value of D and becomes zero. Accordingly, the consideration is made ignoring D. The method for determining the value of D will be explained later. Under such conditions, the values of A, B and C were determined using Newton-Raphson's method which is one of optimization methods such that the square values of the differences between the actually measured values and the predicted values by these equations can be minimized. As a result, the values of A, B and C were respectively set to $A=-9.708\times10^{-4}$ (mm/MPa), B=0.8161, $C=1.082\times10^{-7}$ ($1/mm^2$). The obtained values of A, B and C and the predicted values (ρcal) obtained using the equations (2) to (4) are also shown in the Table 1. The result obtained by comparing the actually measured values (ρmes) and the predicted values (ρcal) is shown in FIG. 14. The high correlation was recognized between the actually measured values (ρmes) and the predicted values (ρcal) so that it is understood that the wall warp amount can be predicted with a favorable accuracy.

Figure 15:
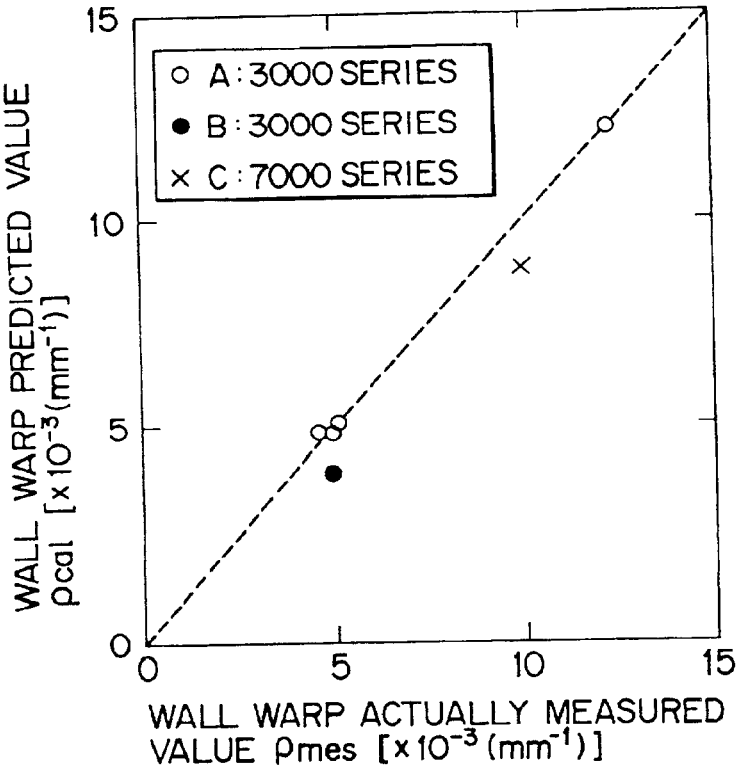
FIG. 15 is a graph showing in comparison an actually measured value (ρmes) and a predicted value (ρcal) based on the above-mentioned equations (2)–(4) with respect to wall warp amounts (curvatures) ρ of various kinds of aluminum sheets shown in Table 2.

Then, it was confirmed whether the above-mentioned equations (2) to (4) and the values of A, B and C obtained by the above-mentioned experiment are applicable to the forming of aluminum sheets which largely differ in the Young's modulus from the steel sheets used in the above-mentioned experiment or not. Using various kinds of aluminum sheets (3000 series, 7000 series) having the yield strength YP, the tensile strength TS and the sheet thickness t shown in following Table 2 and under forming conditions (die shoulder diameter rd) shown in the Table 2 and setting the ratio $\sigma_T$/TS to $\sigma_T$/TS=0.3 (see FIG. 4(*e*) previously mentioned), a "hat channel" specimen forming experiment was carried out. In the same manner as the experiment on the steel sheets, the actually measured values (ρmes) and the predicted values (ρcal) based on the previously mentioned equation (2) to (4) of the wall warp amount ρ (curvature) were compared with each other and the result is shown in FIG. 15. The high correlation was recognized between the actually measured values (ρmes) and the predicted values (ρcal) so that it is understood that the wall warp amount can be predicted with a favorable accuracy.

TABLE 2

| No. | Yield strength (MPa) | Tensile strength (MPa) | Sheet thickness (mm) | Die shoulder radius (mm) | Actually measured value $\rho_{mes}$ [$\times 10^{-3}$ ($mm^{-1}$)] | Predicted value $\rho_{cal}$ [$\times 10^{-3}$ ($mm^{-1}$)] |
|---|---|---|---|---|---|---|
| 19 | | | | 3 | 5.184 | 5.018 |
| 20 | 73 | 177 | 1.0 | 5 | 5.039, 4.777 | 4.802 |
| 21 | | | | 10 | 4.202 | 4.261 |
| 22 | 58 | 153 | 1.0 | 5 | 5.049 | 3.910 |
| 23 | 131 | 284 | 1.0 | 5 | 9.965 | 8.817 |

Figure 16:
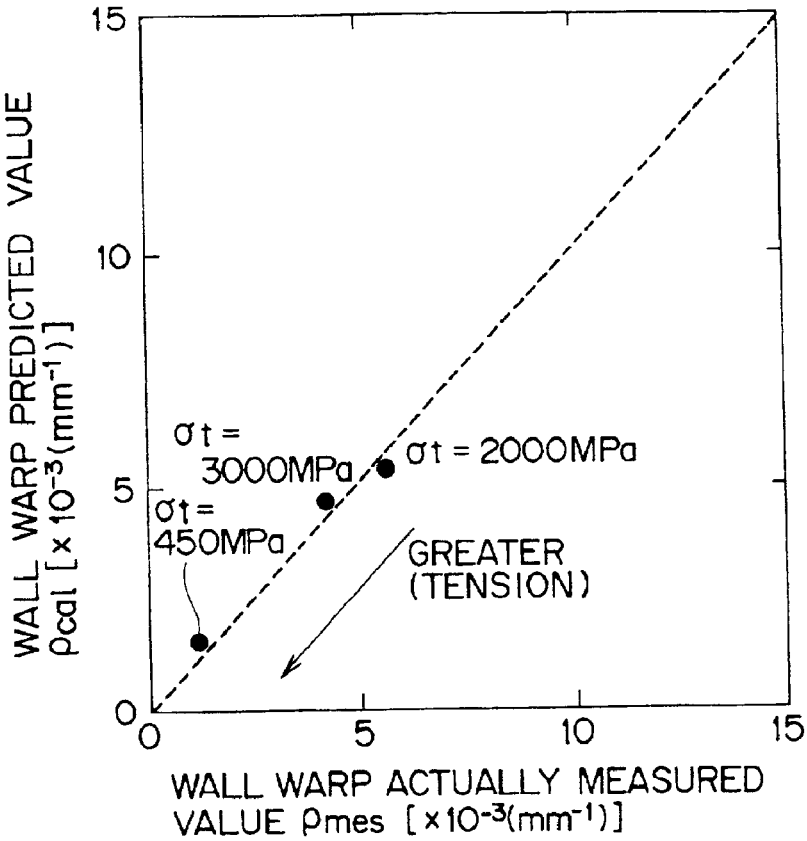
FIG. 16 is a graph showing in comparison an actually measured value (ρmes) and a predicted value (ρcal) based on the above-mentioned equations (2)–(4) with respect to wall warp amounts (curvatures) ρ when the tension $\sigma_T$ is relatively large.

Subsequently, the prediction accuracy in the region in which the tension $\sigma_T$ is relatively large was also confirmed. Here, the adjustment of the coefficient D was conducted so as to correct the influence of the tension. Here, the actually measured values of the wall warp amount were obtained with respect to the specimen No. 2 in the Table 1 by changing the tension $\sigma_T$ to 200 MPa, 300 MPa and 450 MPa with the adjustment of the BHF (blank holding force). Using these actually measured values and the values of the constants A, B and C obtained by the previous experiment, the value of D was determined using Newton-Raphson's method such that the square values of the differences between the actually measured values and the predicted values obtained by the equations (2) to (4) can be minimized. As a result, D was set to D=3.559. The result obtained by comparing these actually measured values (ρmes) and the predicted values (ρcal) is shown in FIG. 16. The high correlation was recognized between the actually measured values (ρmes) and the predicted values (ρcal) so that it is understood that the wall warp amount can be predicted with a favorable accuracy.

Embodiment 2

Figure 17:
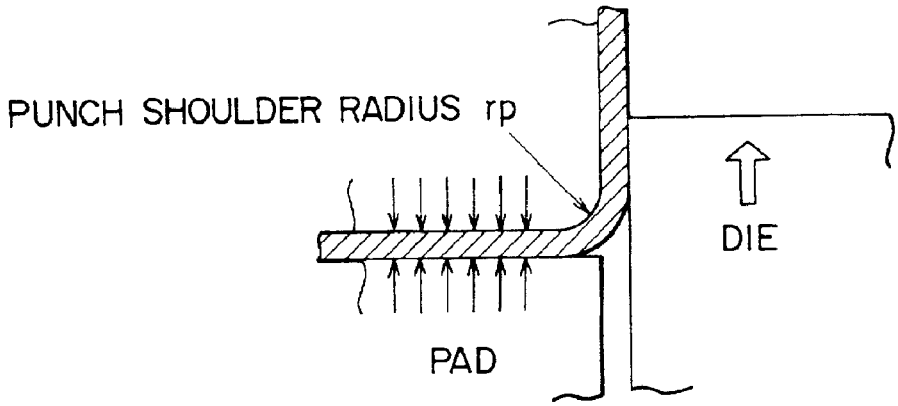
FIG. 17 is a schematic view showing the state of an L-bend forming experiment.

With respect to the prediction accuracy of the prediction equations of the angular change amount Δθ, the evaluation was performed using the basic bending test. First of all, using various kinds of steel sheets having the yield strength YP, the tensile strength TS and the sheet thickness t shown in following Table 3 and under forming conditions (punch shoulder radius rp) shown in the Table 3, an L-bending forming experiment was carried out. The state of the L-bending forming experiment is shown in FIG. 17. With respect to the angular change amount Δθ in the test, the actually measured values (Δθmes) were shown in the Table 3.

TABLE 3

| No. | Yield strength (MPa) | Tensile strength (MPa) | Sheet thickness (mm) | Die shoulder radius (mm) | Actually measured value $\rho_{mes}$ [$\times 10^{-3}$ ($mm^{-1}$)] | Predicted value $\rho_{cal}$ [$\times 10^{-3}$ ($mm^{-1}$)] |
|---|---|---|---|---|---|---|
| 24 | | | | 1 | 0.95 | 0.795 |
| 25 | 176 | 318 | 1.2 | 5 | 2.10 | 2.342 |
| 26 | | | | 10 | 2.70 | 3.771 |
| 27 | | | | 1 | 4.25 | 1.938 |
| 28 | 425 | 647 | 1.2 | 5 | 5.00 | 5.712 |
| 29 | | | | 10 | 8.75 | 9.197 |
| 30 | | | | 1 | 4.70 | 3.437 |

TABLE 3-continued

| No. | Yield strength (MPa) | Tensile strength (MPa) | Sheet thickness (mm) | Die shoulder radius (mm) | Actually measured value $\rho_{mes}$ [$\times 10^{-3}$ ($mm^{-1}$)] | Predicted value $\rho_{cal}$ [$\times 10^{-3}$ ($mm^{-1}$)] |
|---|---|---|---|---|---|---|
| 31 | 672 | 1032 | 1.2 | 5 | 10.30 | 10.128 |
| 32 | | | | 10 | 18.15 | 16.307 |
| 33 | | | | 1 | 5.65 | 4.419 |
| 34 | 1183 | 1327 | 1.2 | 5 | 12.90 | 13.023 |
| 35 | | | | 10 | 19.65 | 20.969 |
| 36 | | | | 1 | 2.55 | 1.563 |
| 37 | 373 | 608 | 1.4 | 5 | 5.00 | 4.412 |
| 38 | | | | 10 | 7.65 | 7.045 |

Figure 18:
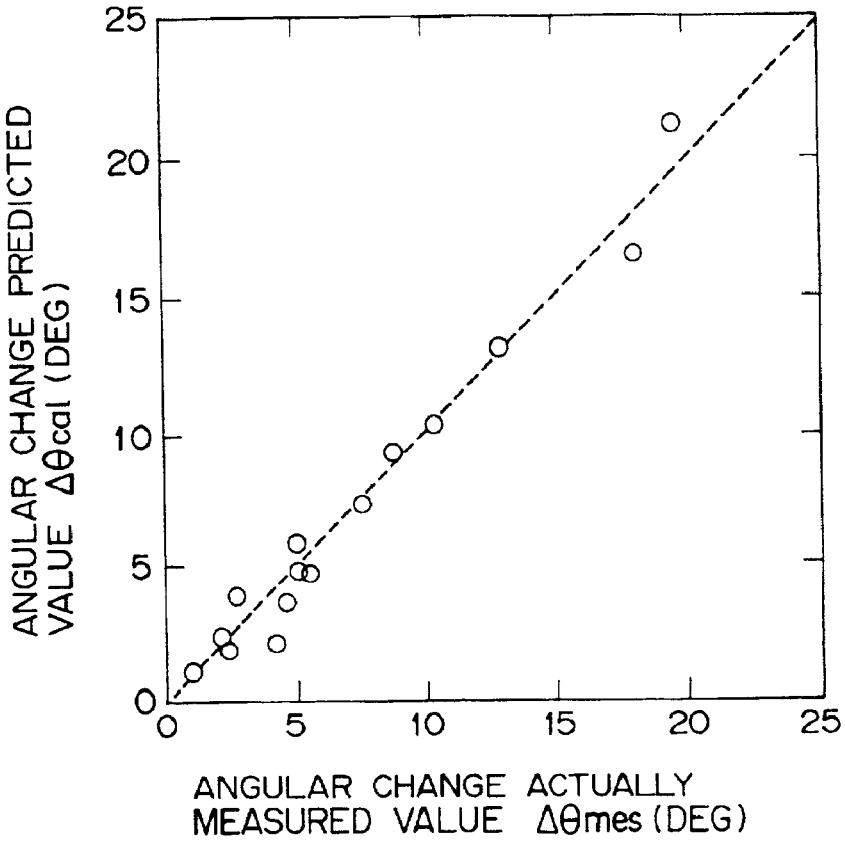
FIG. 18 is a graph showing in comparison an actually measured value (Δθmes) and a predicted value (Δθcal) based on the above-mentioned equations (5)–(8) with respect to angular change amounts Δθ of various kinds of steel sheets shown in Table 3.

Using these actually measured values, the constants A, B and C in the previously mentioned equations (5) to (8) were determined. In the same manner as the prediction equation of the wall warp amount ρ, the constants A, B and C are coefficients provided for determining the apparent yield stress σp'. Accordingly, these values were set identical with the values obtained in the previously mentioned experiment for the wall warp amount. Here, only the coefficient G which is provided for correcting the influence of the punch shoulder radius rp was determined using Newton-Raphson's method such that the square values of the differences between the actually measured values and the predicted values obtained by these equations can be minimized. As a result, the value of G was set to G=0.1012 (mm). The obtained coefficient values and the predicted values obtained using the equations (5) to (8) are also shown in the Table 3. The result obtained by comparing the actually measured values (Δθmes) and the predicted values (Δθcal) is shown in FIG. 18. The high correlation was recognized between the actually measured values (Δθmes) and the predicted values (Δθcal) so that it is understood that the angular change amount can be predicted with a favorable accuracy.

Figure 19:
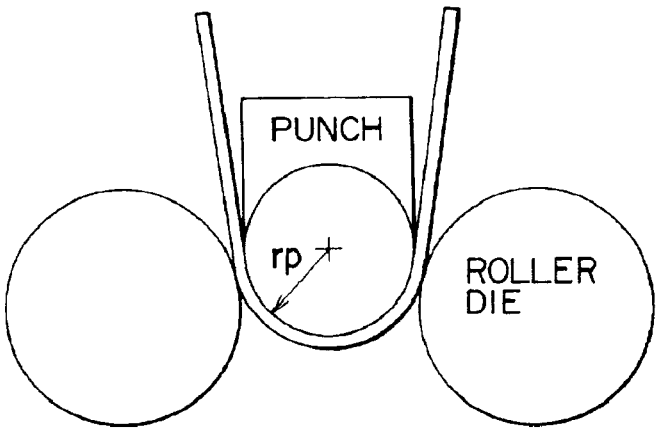
FIG. 19 is a schematic view showing the state of a U-bend forming experiment.

Subsequently, to confirm the prediction accuracy in a region where the punch shoulder radius rp is relatively large, using steel sheets having the yield strength YP, the tensile strength TS and the sheet thickness t shown in following Table 4 and under forming conditions (punch shoulder radius rp) shown in the Table 4, a U-bending forming experiment was carried out. The state of the U-bending forming experiment is shown in FIG. 19.

TABLE 4

| No. | Yield strength (MPa) | Tensile strength (MPa) | Sheet thickness (mm) | Die shoulder radius (mm) | Actually measured value $\rho_{mes}$ [$\times 10^{-3}$ ($mm^{-1}$)] | Predicted value $\rho_{cal}$ [$\times 10^{-3}$ ($mm^{-1}$)] |
|---|---|---|---|---|---|---|
| 39 | | | | 4.8 | 8.987 | 8.619 |
| 40 | 375 | 610 | 1.4 | 9.0 | 15.063 | 13.195 |
| 41 | | | | 18.0 | 20.886 | 21.076 |
| 42 | | | | 38.0 | 38.734 | 38.346 |

Figure 20:
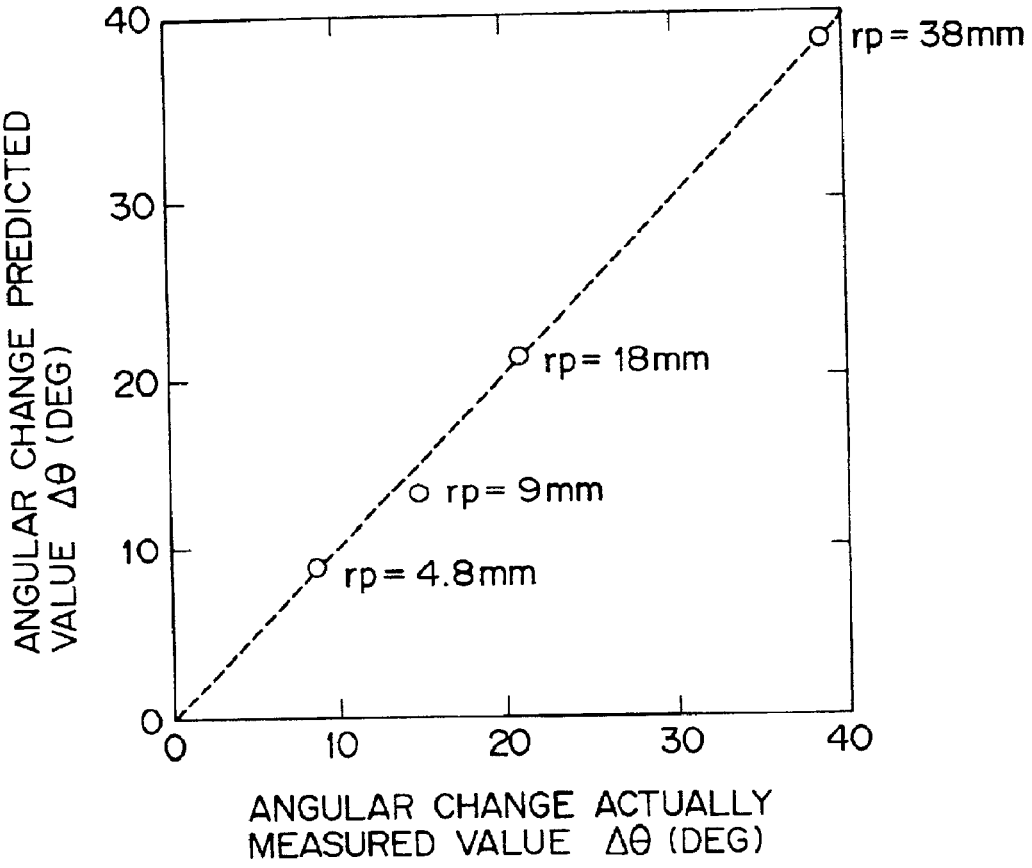
FIG. 20 is a graph showing in comparison an actually measured value (Δθmes) and a predicted value (Δθcal) based on the above-mentioned equations (5)–(8) with respect to angular change amounts Δθ at the time of U-bend forming.

The prediction of the angular change amount Δθ was carried out using the previously mentioned values of A, B, C and G and the previously mentioned equations (5) to (8). The result obtained by comparing the actually measured values (Δθmes) and the predicted values (Δθcal) obtained from the previously mentioned equations (5) to (8) is shown in FIG. 20. The high correlation was recognized between the actually measured values (Δθmes) and the predicted values (Δθcal) so that it is understood that the angular change amount can be predicted with a favorable accuracy.

According to the present invention, with the constitutions which have been explained heretofore, even when engineers having no experience and technical storage do not have expertise such as numerical simulations, they can easily and accurately predict an amount of dimensional accuracy defect at the time of press-forming. Such a method enables engineers to take a prompt and effective measures to enhance the dimensional accuracy against the dimensional accuracy defect which has been considered as a particularly important problem recently and hence the expectation on the technical significance of this method is considered enormous.

What is claimed is:

1. A method for predicting an amount of dimensional accuracy defect at the time of performing a press-forming of a metal sheet comprising:

setting a stress-strain relationship with respect to said metal sheet based on an elastic-perfectly plastic solid material model having a constant stress value after being yielded;

formulating a first prediction equation of an amount of dimensional accuracy defect using said stress-strain relationship based on said elastic-perfectly plastic solid material model;

setting a value which is equal to or below a tensile strength and exceeds a yield strength as an apparent yield strength with respect to said metal sheet;

formulating a second prediction equation of an amount of dimensional accuracy defect which considers work hardening by replacing a portion of said first prediction equation of an amount of dimensional accuracy defect corresponding to said yield strength with said apparent yield strength; and obtaining a dimensional accuracy defect amount using said second prediction equation of an amount of dimensional accuracy defect which considers work hardening.

2. The method for predicting an amount of dimensional accuracy defect according to claim 1, wherein said apparent yield strength is obtained by a following equation (1)

$$\sigma p' = k \cdot YS + (1-k)TS \quad (1)$$

where σp': apparent yield strength (MPa), YS: actually measured yield strength (MPa), TS: tensile strength (MPa), k: internal division coefficient.

3. The method for predicting an amount of dimensional accuracy defect according to claim 2, wherein said internal division coefficient k is set as a function of a ratio (TS/t) between said tensile strength TS and said sheet thickness t.

4. The method for predicting an amount of dimensional accuracy defect according to claim 1, wherein an amount of dimensional accuracy defect which is subjected to a prediction is a wall warp amount at the time of performing press-forming and said second prediction equation of an amount of dimensional accuracy defect which considers work hardening for obtaining said wall warp amount is a following equation (2)

$$\rho = \{(3\sigma p'/E \cdot t)\} \cdot \{1 - D \cdot [(\sigma_T/TS) - 0.3]^2\} - C \cdot (rd - 5) \quad (2)$$

where ρ=wall warp amount (curvature; 1/mm), σp': apparent yield strength (MPa), E: Young's modulus (MPa), t: sheet thickness (mm), TS: tensile strength (actually measured value;

MPa) $\sigma_T$: tension acting on wall portion (MPa), rd: radius of die shoulder of press forming tool (mm), C: constant ($1/mm^2$), D: constant.

5. The method for predicting an amount of dimensional accuracy defect according to claim 4, wherein said apparent yield strength is obtained by a following equation (3)

$$\sigma p' = k \cdot YS + (1-k)TS \quad (3)$$

where σp': said apparent yield strength (MPa), YS: actually measured yield strength (MPa), TS: tensile strength (MPa), k: internal division coefficient.

6. The method for predicting an amount of dimensional accuracy defect according to claim 5, wherein said internal division coefficient k is obtained based on a following equation (4)

$$k = A \cdot (TS/t) + B \quad (4)$$

where TS: said tensile strength, t: sheet thickness, A: negative constant (mm/MPa), B: positive constant.

7. The method for predicting an amount of dimensional accuracy defect according to claim 1, wherein an amount of dimensional accuracy defect which is subjected to a prediction is an angular change amount at the time of performing press-forming and said second prediction equation of an amount of dimensional accuracy defect which considers work hardening for obtaining said angular change amount is comprised of following equations (5) and (6)

$$\Delta\theta = -\theta \cdot (rp + t/2) \cdot \Delta\rho \quad (5)$$

$$\Delta\rho = (-3\sigma p'/E \cdot t) \cdot [1 + \exp(-G \cdot rp)] \quad (6)$$

where Δθ: angular change amount (degree), θ: bending angle (degree), rp: radius of shoulder of bending tool (mm), t: sheet thickness (mm), Δρ: curvature change amount (1/mm), σp': apparent yield strength (MPa), E: Young's modulus (MPa), G: constant(mm).

8. The method for predicting an amount of dimensional accuracy defect according to claim 7, wherein said apparent yield strength is obtained by a following equation (7)

$$\sigma p' = k \cdot YS + (1-k)TS \quad (7)$$

where σp': said apparent yield strength (MPa), YS: actually measured yield strength (MPa), TS: tensile strength (MPa), k: internal division coefficient.

9. The method for predicting an amount of dimensional accuracy defect according to claim 8, wherein said internal division coefficient k is obtained based on a following equation (8)

$$k = A\mathbf{19}\ (TS/t) + B \quad (8)$$

where TS: said tensile strength (MPa), t: sheet thickness(1/mm), A: negative constant (mm/MPa), B: positive constant.

* * * * *